US009290420B2

(12) United States Patent
Schaer et al.

(10) Patent No.: US 9,290,420 B2
(45) Date of Patent: Mar. 22, 2016

(54) PORTABLE DEVICE FOR RAPIDLY INFLATING A BAG

(75) Inventors: Marc-Antoine Schaer, Lignières (CH); Robert Graham, Nods (CH); Laurent Raeber, Neuchâtel (CH)

(73) Assignee: RAS TECHNOLOGY SÀRL, Neuchatel (CH)

( * ) Notice: Subject to any disclaimer, the term of this patent is extended or adjusted under 35 U.S.C. 154(b) by 361 days.

(21) Appl. No.: 13/553,075

(22) Filed: Jul. 19, 2012

(65) Prior Publication Data

US 2013/0019994 A1 Jan. 24, 2013

(30) Foreign Application Priority Data

Jul. 20, 2011 (CH) ..... 1212/11

(51) Int. Cl.

| | |
|---|---|
| ***C06D 5/02*** | (2006.01) |
| ***F17C 7/00*** | (2006.01) |
| *A62B 33/00* | (2006.01) |
| *A63B 29/02* | (2006.01) |

(52) U.S. Cl.

CPC ... *C06D 5/02* (2013.01); *F17C 7/00* (2013.01); *A62B 33/00* (2013.01); *A63B 29/021* (2013.01)

(58) Field of Classification Search

CPC ..... A63B 29/02; A63B 29/021; A62B 33/00; A62B 99/00; A41D 13/018; C06D 5/02

USPC ..... 116/210, DIG. 9; 441/93; 141/313

See application file for complete search history.

(56) References Cited

U.S. PATENT DOCUMENTS

| | | | | |
|---|---|---|---|---|
| 4,635,754 | A | 1/1987 | Aschauer et al. | |
| 4,943,252 | A | 7/1990 | Manix | |
| 5,555,839 | A * | 9/1996 | Staten et al. | 116/210 |
| 6,158,380 | A * | 12/2000 | Aschauer et al. | 116/210 |
| 6,270,386 | B1 | 8/2001 | Visocekas | |
| 7,018,257 | B2 * | 3/2006 | Courtney | 441/93 |
| 7,455,086 | B1 | 11/2008 | Elze et al. | |
| 2002/0175851 | A1 | 11/2002 | Schaumann et al. | |
| 2009/0239428 | A1 | 9/2009 | Berchten | |
| 2010/0006176 | A1 * | 1/2010 | Pansegrouw | 141/10 |
| 2010/0184343 | A1 | 7/2010 | Paynton et al. | |

FOREIGN PATENT DOCUMENTS

| | | | |
|---|---|---|---|
| DE | 2747240 | A1 | 4/1979 |
| DE | 196 22 642 | A1 | 12/1997 |

(Continued)

*Primary Examiner* — Daniel S Larkin
*Assistant Examiner* — Irving A Campbell
(74) *Attorney, Agent, or Firm* — Davis & Bujold PLLC; Michael J. Bujold

(57) ABSTRACT

A portable device for rapidly inflating an inflatable bag is disclosed, which comprises at least one inlet intended to be connected to a source of compressed gas, in order to allow this gas to expand into an air intake chamber, the inlet being associated with a mechanism that triggers the release of the compressed gas to the air intake chamber, the latter having an opening allowing atmospheric air to be admitted and an outlet intended to be connected to the bag that is to be inflated. The device further comprises an intermediate distribution chamber for the compressed gas, which chamber is arranged between the inlet and the air intake chamber in order to connect the one to the other, and ejection holes arranged so as to open into a lateral wall of the air intake chamber in order to connect the latter to the intermediate distribution chamber.

23 Claims, 6 Drawing Sheets

(56) References Cited

FOREIGN PATENT DOCUMENTS

| | | | |
|---|---|---|---|
| DE | 19502417 | C2 | 7/1998 |
| DE | 19545864 | C2 | 10/2000 |
| DE | 10112664 | C1 | 12/2002 |
| EP | 0723790 | A2 | 7/1996 |
| WO | WO 84/01300 | A1 | 4/1984 |
| WO | WO 96/35479 | A1 | 11/1996 |
| WO | WO 98/33559 | A1 | 8/1998 |
| WO | WO 01/08114 | A2 | 2/2001 |
| WO | WO 2004/107888 | A1 | 12/2004 |
| WO | WO 2008/077464 | A2 | 3/2008 |

* cited by examiner

PORTABLE DEVICE FOR RAPIDLY INFLATING A BAG

TECHNICAL FIELD

The present invention relates to a portable device for rapidly inflating an inflatable bag such as, for example, an avalanche airbag.

The device according to the invention, which might be of elongate overall shape, may comprise at least one inlet intended to be connected to a source of compressed gas at high pressure, in order to allow this gas to expand into an air intake chamber, the inlet being associated with a mechanism that triggers the release of the compressed gas to the air intake chamber. The latter may have an opening allowing atmospheric air to be admitted and an outlet intended to be connected to the bag that is to be inflated.

BACKGROUND

Devices of this type have already been disclosed, for example in patent U.S. Pat. No. 6,220,909 B1. That document describes an avalanche airbag inflation device intended to operate notably using a cartridge of nitrogen compressed to 200 bar. The cartridge is assembled with a control mechanism that allows the gas to be released in response to a user action. The gas, once released following the piercing of the cartridge, is conveyed to two inflation mechanisms, by pipes, each inflation mechanism being associated with an inflatable bag.

The gas is injected into a cylindrical air intake chamber provided in each of the inflation mechanisms by an injection nozzle arranged substantially in line with the central axis of the air intake chamber. This chamber comprises a plurality of openings in its lateral wall so that atmospheric air can be sucked in in response to the injection of the high-pressure gas. The air sucked in is accelerated by a Venturi effect to inflate the corresponding inflatable bag quickly with a sufficient volume, by applying a multiplication factor (volume of air/volume of compressed gas) to that of the volume of compressed gas available, thanks to the addition of the air.

Each of the inflation mechanisms further comprises a non-return check valve to prevent the corresponding inflatable bag from becoming deflated via the inlet when it is fully inflated.

As an alternative to nitrogen, it is also known practice to use compressed air as the compressed gas at high pressure.

In general, the multiplication factor applied in the known devices is not very high, of the order of 2 to 3 (which means that the volume of atmospheric air injected into the airbag is of the order of 2 to 3 times the volume that the gas represents in the airbag once it has expanded) and entails the use of a significant volume of compressed gas in order to be able to inflate the airbag.

The space occupied by the compressed-gas cartridge thus contributes significantly to the overall space occupied by the inflation device, and this is why the abovementioned US Patent proposes a design of the device that comes in modular form, which means to say that allows the various component parts of the device to be located at different parts of a pack for example.

However, in that case, getting the device into or out of a backpack, for example, is a complicated matter because each of its component parts has its own means of attachment that have to be done up or undone.

It will also be noted that, aside from the requirement that has to be observed regarding the airbag inflation volume, it is absolutely essential that the airbag be inflated quickly. As a general rule, an avalanche airbag needs to be inflated in around 2 to 4 seconds.

SUMMARY

A main objective of the present invention is to alleviate the disadvantages of the inflation devices known from the prior art by proposing such a device that may effectively meet the abovementioned demands, and notably that may allow an airbag to be inflated within the required timeframe and that may occupy a smaller amount of space and is easier to fit/remove.

To this end, the invention relates more specifically to an inflation device of the type mentioned above, further comprising an intermediate distribution chamber for the compressed gas, which chamber may be arranged between the inlet and the air intake chamber in order to connect the one to the other, and a plurality of ejection holes arranged so as to open into a lateral wall of the air intake chamber in order to connect the latter to the intermediate distribution chamber.

By virtue of these features, the device according to the invention is more effective at admitting atmospheric air, and this means that it is able to achieve a higher multiplication factor than the known devices and that it is therefore possible to make use of compressed-gas cartridges of smaller size.

Preferably, the intermediate distribution chamber may be at least partially annular in overall shape and may be arranged at the periphery of the intake chamber. Furthermore, the lateral wall of the intake chamber into which the ejection holes open may be located between the opening and the outlet.

According to one preferred embodiment, the device may comprise a first cylindrical tube the internal wall of which defines the lateral wall of the intake chamber, and a second cylindrical tube, coaxial with the first tube and arranged at least partially around it in order between them to define the intermediate distribution chamber. At least two seals may be provided to delimit this chamber in an axial direction.

The first and second tubes may advantageously be joined together by screw-fastening or by a bayonet mechanism.

Such a design makes it possible to guarantee a simplified method of manufacturing the various component parts of the device, and for assembling or dismantling them, for example for servicing operations.

Moreover, the ejection holes may preferably be inclined more or less by between 10 and 20 degrees with reference to the longitudinal direction of the device, and have a diameter more or less of between 0.2 and 1 mm, preferably between 0.5 and 0.8 mm.

The device may advantageously comprise between 2 and 10 ejection holes.

As a preference, the inlet may have an attachment member for attaching a sealed cartridge containing a compressed gas at high pressure. Further, the trigger mechanism may comprise a first needle controlled by a drive mechanism that a user can actuate so that it can move between at least a first position and a second position and pierce the sealed cartridge in order to release the compressed gas therefrom.

The attachment member may advantageously comprise a tapped thread that can be screwed-together with a male screwthread provided on the sealed cartridge.

Moreover, according to a preferred embodiment, the device may comprise a second inlet similar to the first inlet and intended to accept a second sealed cartridge of compressed gas and which is associated with an additional trigger mechanism comprising a second needle designed to be operated substantially at the same time as the first needle and to pierce the second sealed cartridge in order to release the compressed gas therefrom.

By virtue of these features, carbon dioxide cartridges can be used. Now, carbon dioxide is a gas which is highly compressible, which means that a large potential volume of it can be stored in a cartridge of the kind used in current airbags. This is one of the reasons, aside from its low cost, why this gas is generally used for inflating lifejackets in vehicles of the boat or aeroplane type, for example.

However, the expansion of this gas consumes a great deal of energy, which causes it to cool rapidly as it expands and carries with it the risk of it freezing. A device having the above characteristics however makes it possible to avoid these difficulties which are specific to carbon dioxide and to harness all the advantages of its use with reference to the other gases.

Furthermore, it is also possible, as a preference, to plan that the intake chamber may comprise an acceleration cone arranged between the ejection holes and the outlet, preferably having a length more or less of between 60 and 150 mm.

Moreover, the device may advantageously comprise a reversible-attachment member for reversible attachment to an inflatable bag, this member preferably being arranged some distance from the outlet so that the acceleration cone can be at least partially housed in the inflatable bag in the use configuration.

The present invention also relates to an assembly comprising a device corresponding to the above features and an inflatable bag, possibly with at least one sealed high-pressure compressed-gas cartridge.

BRIEF DESCRIPTION OF THE DRAWINGS

Other features and advantages of the present invention will become more clearly apparent from reading the detailed description of a preferred embodiment which follows, given with reference to the appended drawings provided by way of nonlimiting examples and in which.

DETAILED DESCRIPTION

Figure 1:
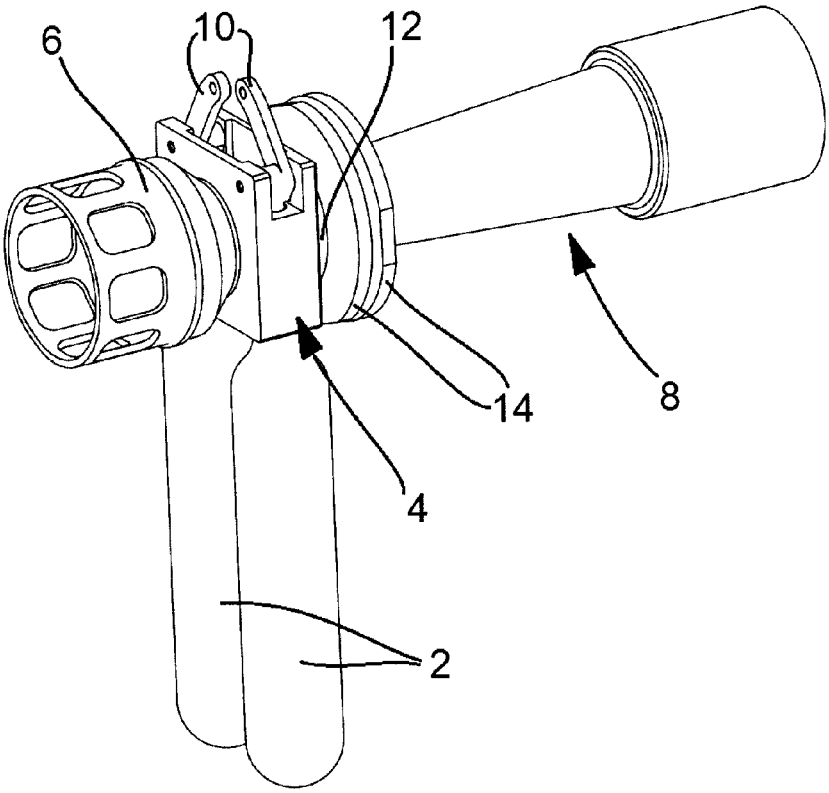
FIG. 1 is a simplified perspective view of a portable device for the rapid inflation of an inflatable bag according to one preferred embodiment of the present invention.

FIG. 1 depicts a simplified perspective view of a portable device for the rapid inflation of an inflatable bag according to a preferred embodiment of the present invention. More specifically, the device illustrated is particularly well-suited to rapidly inflating a bag of the avalanche airbag type.

The device of FIG. 1, of elongate overall shape, is designed to inflate an airbag using two sealed cartridges 2 of compressed gas.

Advantageously but without implying any limitation, the cartridges 2 may be standard carbon dioxide cartridges, preferably each containing 33 grams of carbon dioxide, at a pressure of the order of 200 bar and available more or less worldwide at a very modest cost. These cartridges are actually generally used, for example, to inflate the lifejackets found on aeroplanes.

The cartridges 2 are assembled with a central body 4 of the device. The latter bears an air intake cylinder 6 on a first side and an air ejection tube 8 on the other side. It is preferable to position a filter, not illustrated, around the air intake cylinder 6 to prevent a large-sized element from blocking the latter.

Moreover, first and second levers 10 which are intended to be pivoted in response to an action by a user to release the compressed gas are assembled with the central body 4.

What is more, the central body 4 here has a threaded cylindrical support portion 12 onto which airbag retaining washers 14 are screwed. What happens is that a circular opening may be provided in the airbag into which to insert the air ejection tube 8 and one of the two washers 14, the other washer then being screwed against the first one in order to trap the periphery of the opening in the airbag, thereby immobilizing it.

Of course, a person skilled in the art will have no particular difficulty in implementing alternative means for attaching the inflation device to the airbag without departing from the scope of the invention.

Figure 2:
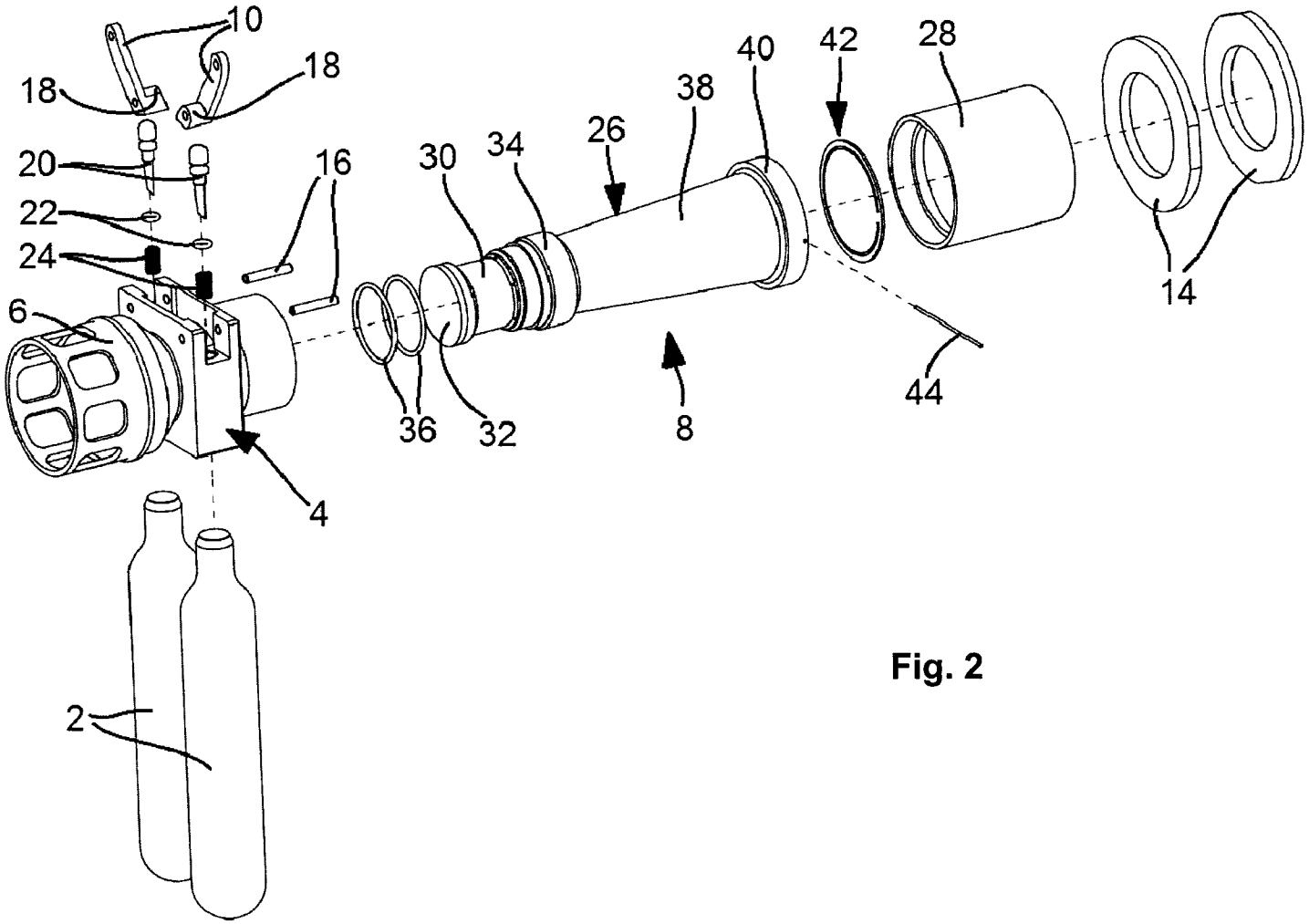
FIG. 2 is an exploded and simplified perspective view of the device of FIG. 1.

FIG. 2 is a simplified and exploded perspective view of the device of FIG. 1, providing a better understanding of its construction.

It is clear from FIG. 2 that the levers 10 are pivot-mounted on the central body 4 via rods 16.

Each lever 10 bears a cam 18, produced as one piece with the lever in this instance by way of illustration, and designed to act on a needle 20 mounted with the freedom to effect a translational movement in a matched bore 21 of the central body, with the interposition of a seal 22 and a spring 24, the functions of which will be explained later on.

The ejection tube 8 comprises a main portion 26 intended to be screwed into the central body 4 and intended to support a cylindrical portion 28 defining the outlet of the device into the airbag.

Figure 5:
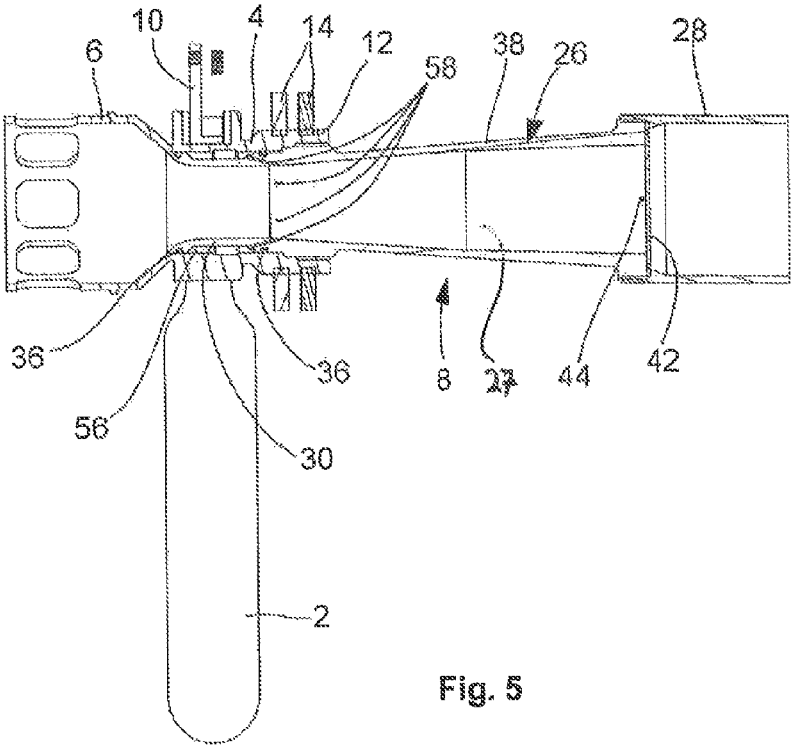
FIG. 5 is a simplified overall view in cross section of the device of FIG. 1.

The main portion 26 has a first part 30, of cylindrical overall shape, intended to define the inlet of an air intake chamber 32 at its centre and an intermediate distribution chamber in communication with the central body 4, as will become apparent from the detailed description of FIG. 5.

The first part 30 also has a male screwthread 34 so that it can be screwed into the central body, with the interposition of two seals 36 or O-rings, distant from one another in the longitudinal direction of the device.

A second part 38 extends the first and has a conical overall shape. The main function of this second part is to accelerate the air introduced via the inlet of the air intake chamber 32, by a Venturi effect, in the known way and thus by an acceleration cone 27, so that it can be injected into the air bag and inflate the latter.

The second part 38 bears a cylindrical male screwthread 40 at the end of the large-diameter conical part, onto which the end portion 28 can be screw-fastened.

A nonreturn membrane 42 is interposed between the second part 38 and the end portion 28 and is clamped between these two elements.

The nonreturn membrane here is produced in the form of a disc having a circular slot near its periphery extending over a little less than 360 degrees, so as to define a central disc held on the periphery by a thin tongue of material.

Thus, the central disc is able to pivot with respect to the peripheral portion in order to allow air to pass in one direction, but is blocked against the second portion 38 in the other direction in order to prevent the gas and the air from leaving the airbag.

The nonreturn membrane offers optimum dependability and robustness for a low number of components.

It will be noted that a thin rod 44 may be provided, in the second portion 38 as a safety measure, to define an end stop for the pivoting disc and prevent the nonreturn membrane from deforming in the airbag outlet direction, something which could happen if a high and sudden pressure were applied to it were such a stop not present.

Figure 3:
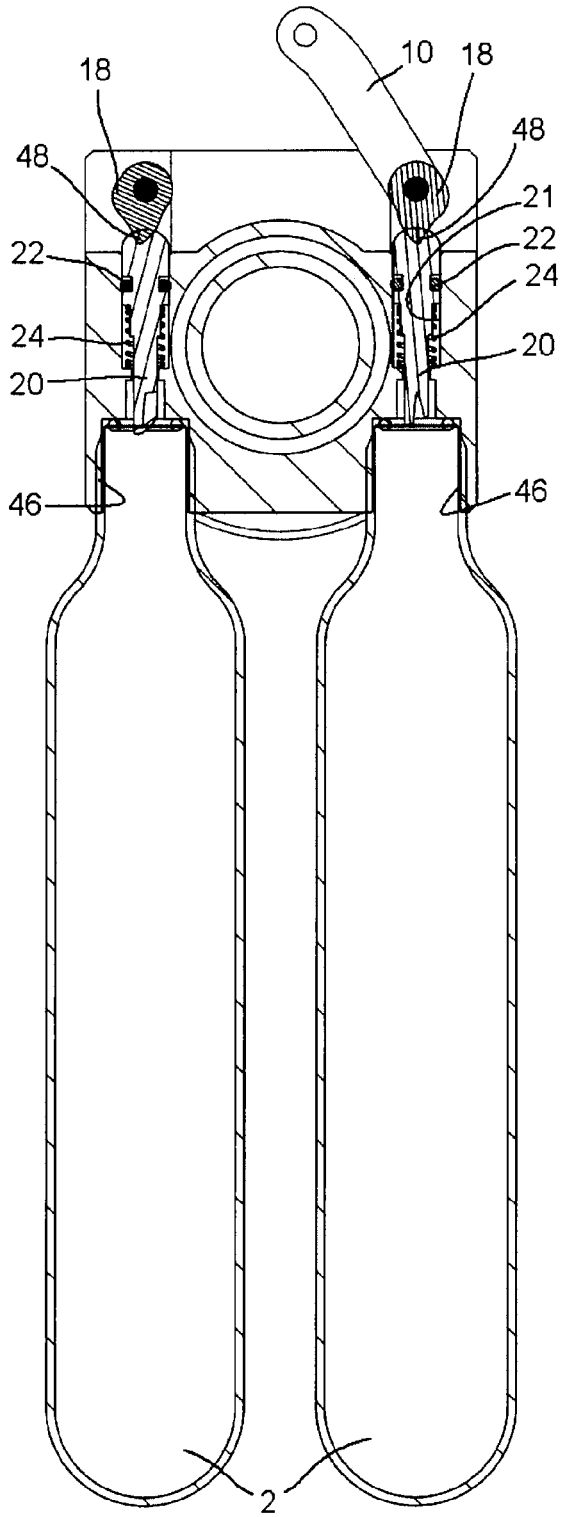
FIG. 3 is a simplified view in cross section of a detail of the construction of the device of FIG. 1.

FIG. 3 is a simplified view in cross section of a detail of construction of the device of FIG. 1 and, more specifically, of the mechanism that triggers the release of the gas from the cartridges 2.

Each cartridge 2 is screwed to an inlet 46 of the inflation device, along the axis of movement of the needles 20.

Each cam 18 has a cam lobe 48 intended to apply pressure to the corresponding needle against the force of the spring 24 kept in abutment in the central body.

Thus, when the lever is pivoted, the cam lobe 48 pushes against the needle which pierces the corresponding gas cartridge in order to release the compressed gas.

As the lever continues to turn in the direction for activating the device, the cam offers the needle a smaller-diameter portion so that the needle can retreat and thus allow the gas to be released more quickly.

It will be noted that the levers 10 are mounted top to tail to limit the amount of torque applied to the device when a user activates it.

Figure 4:
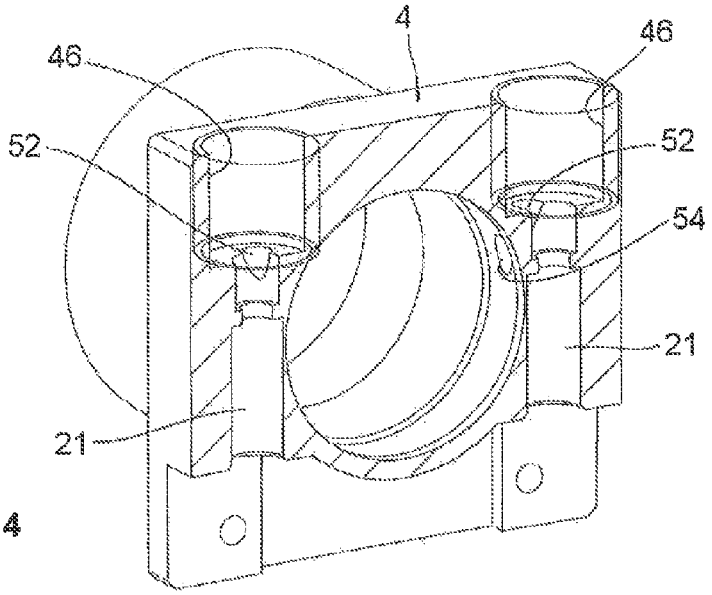
FIG. 4 is a simplified perspective view in partial cross section of a detail of the construction illustrated in FIG. 3.

FIG. 4 is a simplified perspective view in partial cross section of a detail of construction illustrated in FIG. 3, particularly of the central body 4, although for the sake of clarity, the mechanisms that trigger the release of the gas and the cartridges have not been depicted.

Each needle 20 is housed in a matched bore 21 of the central body 4.

Recesses 52 are formed in the bore to allow the compressed gas to be released even if the needles 20 remain in their depressed position. The bevelled shape of the needles offers an additional safety feature with regard to dependability.

Further, each bore communicates with the inside of the central body via an oblique passage 54 formed near the corresponding inlet 46. The simplicity of this construction means that it retains good durability.

FIG. 5 is a simplified overall view in cross section of the device of FIG. 1.

When the air ejection tube 8 is assembled with the central body 4, these two tubular elements between them define an annular cavity that forms an intermediate distribution chamber 56 for the compressed gas, into which chamber the oblique passages 54 open. This intermediate chamber is delimited by the internal wall of the central body, the external wall of the first part 30 of the main portion 26 of the ejection tube, and the two seals 36, in the longitudinal direction of the device.

Ejection holes 58 are provided to cause the intermediate distribution chamber 56 to communicate with the air intake chamber 32 and inject the compressed gas into the latter.

When the compressed gas is injected into the air intake chamber 32, it creates a depression which causes an inrush of atmospheric air through that opening of the intake chamber that is connected to the air intake cylinder 6.

The mixture of gas and air is then driven into the second part 38 of the main portion 26 of the ejection tube, before emerging therefrom via the end portion 28, after activating the nonreturn membrane 42, in order to inflate the airbag.

It will be noted that the first and second tubes, namely the central body and the ejection tube, may as an alternative be secured to one another by a bayonet mechanism, for example.

The design described hereinabove makes it possible to guarantee a simplified method of manufacturing the various component parts of the device, and for assembling or dismantling them, for example for servicing operations.

Moreover, the ejection holes 58 preferably have an inclination more or less of between 10 and 20 degrees with reference to the longitudinal direction of the device, preferably of the order of 15 degrees, and a diameter more or less of between 0.2 and 1 mm, preferably of between 0.5 and 0.8 mm.

The device advantageously comprises between 2 and 10 ejection holes, preferably between 4 and 8 and more preferably still, 6.

The applicant company has taken measurements based on the above information and which have revealed that a multiplication factor of the order of 4 to 5 can be achieved with carbon dioxide, for an inflation time of the order of 2 to 4 seconds. A high multiplication factor makes it possible to limit fluctuations in the inflated volume of the airbag as a function of temperature, which fluctuations are connected with the high thermal expansion coefficient of carbon dioxide.

The use of two small-volume cartridges rather than one cartridge of a larger volume means that the time taken to empty a cartridge can be reduced, thus eliminating any risk of icing which could impair the rate at which the airbag is inflated.

Figure 6:
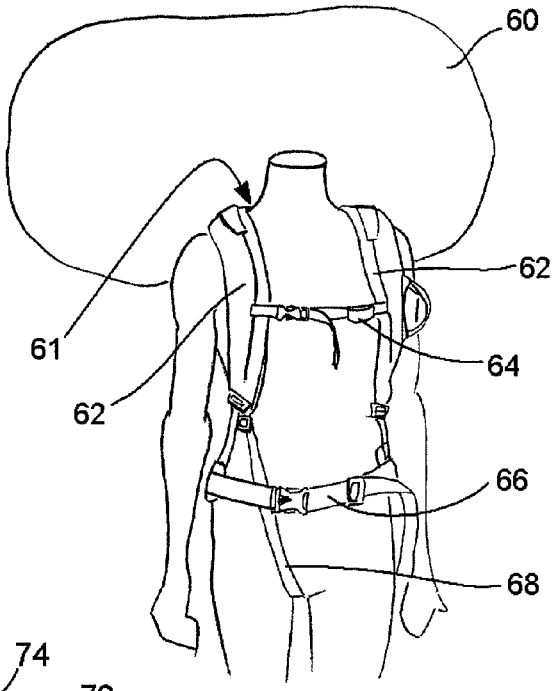
FIG. 6 is a simplified diagram of an assembly incorporating a device as illustrated in FIG. 1.
Figure 7:
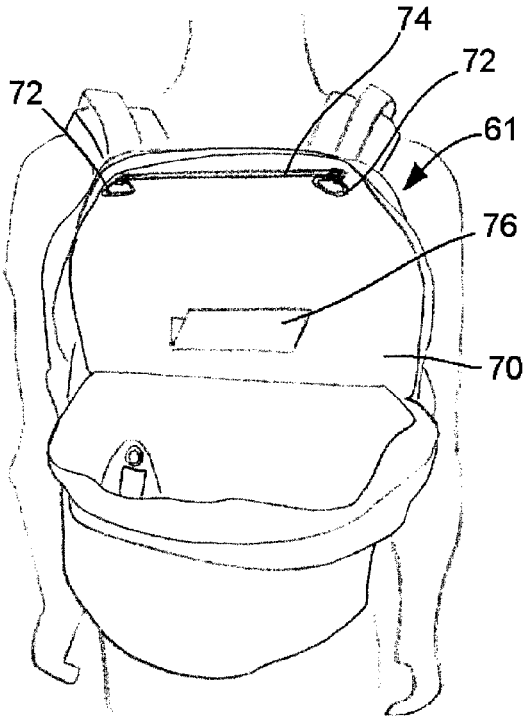
FIG. 7 is a simplified diagram of a pack intended to incorporate the assembly of FIG. 6.
Figure 8:
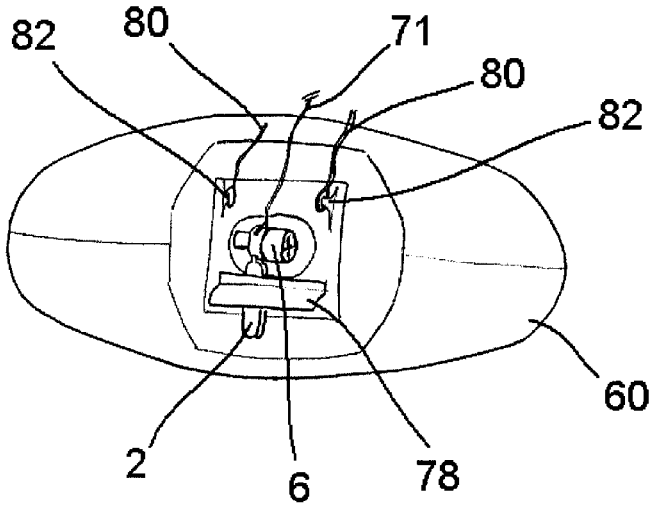
FIG. 8 is a simplified diagram of a detail of the construction of the assembly of FIG. 6.

FIGS. 6 to 8 schematically and in a simplified manner illustrate all or part of an assembly incorporating a device as has just been described.

FIGS. 6 to 8 illustrate the functioning of the inflation device according to the present invention when used to inflate an avalanche airbag.

FIG. 6 illustrates the inflated airbag 60 when attached to a backpack 61 having conventional shoulder straps 62, as well as a chest strap 64, a hip belt 66 and a leg strap 68 that secures the backpack better on its wearer.

Advantageously, the airbag comprises a drain bung (not visible).

FIG. 7 illustrates a pocket 70 of the backpack 61 which pocket is intended to house the folded airbag. Advantageously, the pocket 70 may be closed by a zip-fastener of the frangible type, released by pulling a cord (numerical reference 71 in FIG. 8) connected to the levers 10 in order to release the airbag at the moment when inflation thereof is triggered.

The pocket comprises, by way of non-limiting illustration, two D-rings 72 the relative distance between which is kept fixed by a reinforcing bar 74.

Moreover, a first piece 76 of Velcro® is arranged in the pocket 70 and intended to collaborate with a second piece of Velcro® (numerical reference 78 in FIG. 8) secured to the airbag 60.

Thus, the airbag 60 can be installed in the pocket 70 with the two pieces of Velcro® engaging with one another, as is clear from FIGS. 7 and 8, before cords 80 are fitted to attach fasteners 82 of the airbag 60 to the D-rings 72. The airbag is preferably reinforced in the region of attachment of the fasteners 82 and of the inflation device.

It will be noted that the inflation device/airbag assembly forms a self-contained assembly that can easily be fitted in or removed from a backpack or transferred from one pack to another. Further, the construction of this assembly minimizes the dynamic stresses that might arise between the inflation device and the airbag and which could detract from the operational effectiveness of the assembly.

The foregoing description corresponds to a preferred embodiment of the invention which has been described non-limitingly. In particular, the shapes depicted and described for the various constituent parts of the inflation device are not limiting.

Thus, it is possible to foresee various alternative forms of embodiment, notably as far as the piercing mechanism is concerned. The cam lobes 48 which pierce the cartridges by acting on the needles may, for example, be formed on a rod that can be moved from a rest position to a piercing position by means of a single operating lever, without departing from the scope of the present invention. The lever could in particular collaborate with a pin secured to the rod to move it translationally in response to an action from the user. With such a construction, the reliability of the piercing mechanism is improved insofar as having just one lever means that only one cable for operating it need be provided. Furthermore, the cam lobes may be formed on the rod in such a way that they act on the corresponding needles with a slight offset over time, thus reducing the force needed to pierce the two cartridges as compared with the force required for simultaneous piercing.

The device according to the present invention makes it possible to create an inflation device/airbag assembly as a single unit which is at once compact, lightweight, and easy to fit or remove.

What is claimed is:

1. A portable device for rapidly inflating an inflatable bag, the portable device comprising:

a central body including at least a first inlet and an air intake cylinder, the at least first inlet configured to be connected to a source of compressed gas at high pressure and the air intake cylinder configured to admit atmospheric air;

an air ejection tube including a main portion and an end portion; wherein the main portion includes a first part and a second part, the first part having an opening defining an inlet of an air intake chamber configured to introduce the atmospheric air admitted via the air intake cylinder; and the end portion defines an outlet of the device and is configured to connect to the inflatable bag;

an intermediate distribution chamber arranged between the first inlet and the air intake chamber, the intermediate distribution chamber connecting the first inlet with the air intake chamber; and a plurality of ejection holes located in a lateral wall of the air intake chamber, the plurality of ejection holes connecting said air intake chamber to the intermediate distribution chamber;

wherein the first inlet is associated with a trigger mechanism configured to trigger the release and expansion of the compressed gas into the air intake chamber creating a depression which causes an inrush of atmospheric air through the air intake cylinder and the air intake chamber which is then driven into the second part and emerges from the end portion to inflate the inflatable bag.

2. The portable device of claim 1, wherein said intermediate distribution chamber is at least partially annular in overall shape and is arranged at the periphery of said air intake chamber.

3. The portable device of claim 2, wherein said lateral wall of said air intake chamber is located between said opening and said outlet in a longitudinal direction of the device.

4. The portable device of claim 1, wherein said lateral wall of said air intake chamber is located between said opening and said outlet in a longitudinal direction of the device.

5. The portable device of claim 1, wherein an internal wall of the main portion defines said lateral wall of said air intake chamber, and the central body, coaxial with said first cylindrical tube and arranged at least partially around it in order to define said intermediate distribution chamber between them, at least two seals being provided to delimit said intermediate distribution chamber in a longitudinal direction of the device.

6. The portable device of claim 5, wherein the main portion and the central body are joined together by screw-fastening or by a bayonet mechanism.

7. The portable device of claim 5, wherein said ejection holes are inclined between 10 and 20 degrees with reference to a longitudinal direction of the device.

8. The portable device of claim 7, wherein said portable device comprises between 2 and 10 ejection holes.

9. The portable device of claim 8, wherein said ejection holes have a diameter between 0.2 and 1 mm.

10. The portable device of claim 9, wherein said ejection holes have a diameter between 0.5 and 0.8 mm.

11. The portable device of claim 5, wherein said inlet has an attachment member for attaching a sealed cartridge containing a compressed gas at high pressure, and wherein said trigger mechanism comprises a first needle controlled by a drive mechanism that a user can actuate so that it can move between at least a first position and a second position and pierce said sealed cartridge in order to release said compressed gas therefrom.

12. The portable device of claim 11, wherein said attachment member comprises a tapped thread that can be screwed-together with a male screwthread provided on the sealed cartridge.

13. The portable device of claim 11, further comprising a second inlet similar to said first inlet and intended to accept a second sealed cartridge of compressed gas and which is associated with an additional trigger mechanism comprising a second needle designed to be operated substantially at the same time as said first needle and to pierce said second sealed cartridge in order to release said compressed gas therefrom.

14. The portable device of claim 11, wherein the second part comprises an acceleration cone arranged between said ejection holes and said outlet.

15. The portable device of claim 14, further comprising a reversible-attachment member for reversible attachment to an inflatable bag, wherein said attachment member is distant from said outlet so that said acceleration cone can be at least partially housed in said inflatable bag in a use configuration.

16. The portable device of claim 14, wherein said acceleration cone has a length between 60 and 150 mm.

17. The portable device of claim 1, wherein said ejection holes are inclined between 10 and 20 degrees with reference to a longitudinal direction of the device.

18. The portable device of claim 1, wherein said inlet has an attachment member for attaching a sealed cartridge containing a compressed gas at high pressure, and wherein said trigger mechanism comprises a first needle controlled by a drive mechanism that a user can actuate so that it can move between at least a first position and a second position and pierce said sealed cartridge in order to release said compressed gas therefrom.

19. The portable device of claim 1, wherein the second part comprises an acceleration cone arranged between said ejection holes and said outlet.

20. The portable device of claim 19, wherein said acceleration cone has a length between 60 and 150 mm.

21. An assembly comprising a portable device for inflating an inflatable bag according to claim 1 and an inflatable bag, said portable device comprising an attachment member to allow it to be assembled with said inflatable bag.

22. The assembly of claim 21, further comprising at least one sealed cartridge of compressed carbon dioxide at high pressure.

23. A pack comprising the assembly of claim 21.

* * * * *